US005247267A

United States Patent [19]

Yee et al.

[11] Patent Number: 5,247,267

[45] Date of Patent: Sep. 21, 1993

[54] UTILIZING THERMAL CONDUCTORS TO INCREASE OPERATING POWER OF COAXIAL MICROWAVE DEVICES

[75] Inventors: Harold H. Yee, Rancho Palos Verdes; Robert Morgen, Los Angeles, both of Calif.

[73] Assignee: Hughes Aircraft Company, Los Angeles, Calif.

[21] Appl. No.: 776,011

[22] Filed: Oct. 15, 1991

[51] Int. Cl.[5] ..... H01P 1/10

[52] U.S. Cl. ..... 333/105; 333/262; 333/263; 174/16.3

[58] Field of Search ..... 333/105-108, 333/258-260, 262, 263; 200/504; 174/28, 16.3

[56] References Cited

U.S. PATENT DOCUMENTS

| | | | |
|---|---|---|---|
| 2,652,544 | 9/1953 | Muchmore | 333/260 |
| 2,826,746 | 3/1958 | Lanctot | 200/504 X |
| 2,968,776 | 1/1961 | Book | 333/105 X |
| 3,372,349 | 5/1968 | Concelman | 333/105 |
| 3,600,542 | 3/1969 | Richter | 200/504 X |
| 4,369,415 | 1/1983 | Schwarzmann | 333/127 |
| 4,618,840 | 10/1986 | Yee et al. | 333/108 X |

*Primary Examiner*—Robert J. Pascal
*Assistant Examiner*—Seung Ham
*Attorney, Agent, or Firm*—G. R. Lindeen, III; W. K. Denson-Low

[57] ABSTRACT

A coaxial microwave device, such as a microwave switching device, for example, having improved thermal and power handling characteristics. At least one thermally conductive short-circuit element is located between inner (input and output) and outer conductors of the microwave coaxial or switching device. Consequently, heat losses generated in the inner conductors are conductively channeled away from heat sensitive materials. Typically, quarter-wavelength elements provide a thermal path to reduce heat buildup, thus enabling the microwave coaxial device or switching device to operate at higher RF power levels without overstressing components or materials. However, short circuit elements having element lengths other than one-quarter-wavelength may be employed to offset mismatches in a transmission line, for example. Furthermore, the short circuit elements may be used singularly or in pairs to provide for improved thermal and power handling characteristics in the devices in which they are used.

7 Claims, 3 Drawing Sheets

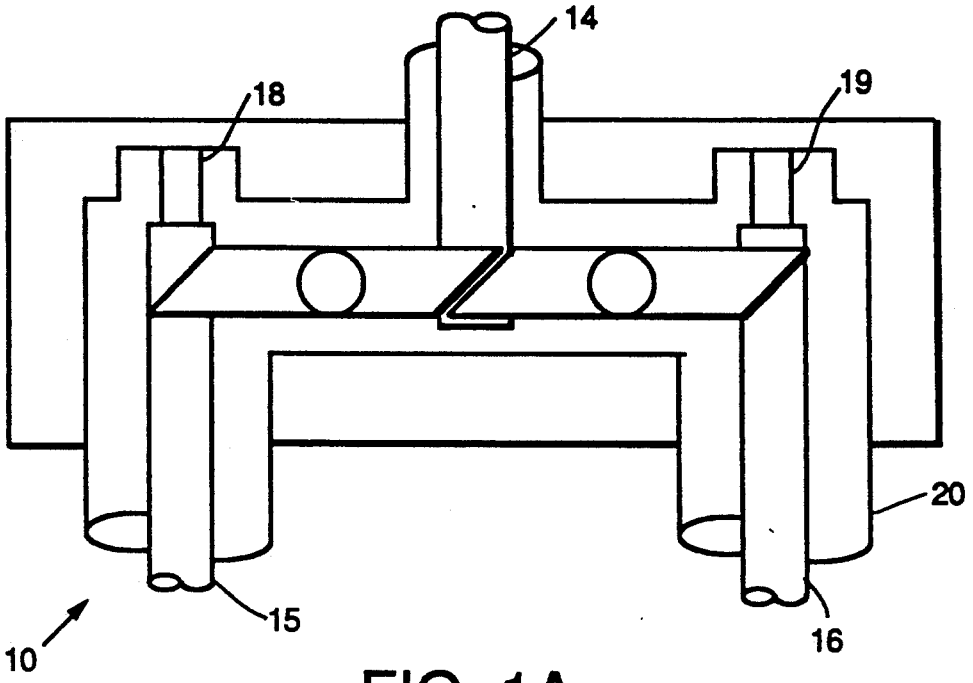
FIG. 1A.
FIG. 1B.
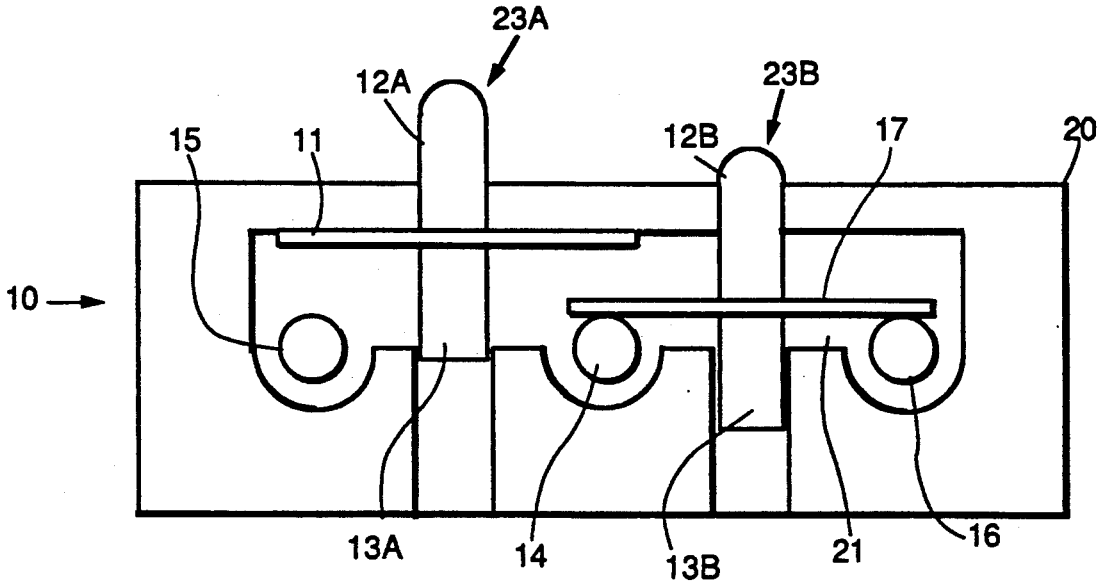

UTILIZING THERMAL CONDUCTORS TO INCREASE OPERATING POWER OF COAXIAL MICROWAVE DEVICES

BACKGROUND

The present invention relates generally to coaxial microwave devices, and more particularly, to coaxial microwave devices employing short-circuit elements to increase operating power capability.

Common methods currently used to increase the power handling capability of a coaxial microwave device include: enlarging its size; providing heat radiators; using high emissivity coatings on the components; pressurizing the device; using highly conductive materials; and using higher temperature materials. The methods that enlarge the device size or use heat radiators generally result in larger and more expensive device. The methods that use high emissivity coatings on the compounds, hermetically seal the device, or use highly conductive materials provide only a partial remedy, not a complete solution, because the only slightly improve heat transfer. Materials that can operate at high temperatures are, in many cases, not mechanically or electrically suitable.

Accordingly, in would be an advantage in the microwave device art to have a coaxial microwave device that has higher power handling capacity than conventional devices, but does not increase the cost or relative size of the device.

SUMMARY OF THE INVENTION

The present invention is adapted to overcome the disadvantages of conventional coaxial microwave devices, such as microwave switches, for example. The present invention comprises a microwave coaxial device, and in one particular exemplary embodiment, a microwave switching device, having improved thermal and power handling characteristics.

In accordance with the principles of the present invention, at least one thermally conductive short-circuit element is located between inner (input and output) and outer conductors of a microwave coaxial device or switching device. Heat losses generated in the inner conductors are conductively channeled away from heat sensitive materials by the short-circuit element. Typically, the short-circuit element is a quarter-wavelength element that provides a thermal path to reduce heat buildup. The use of the short-circuit element enables the microwave coaxial device or switching device to operate at higher RF power levels without overstressing components or materials.

Short-circuit elements having element lengths other than one-quarter-wavelength may be employed to offset mismatches in a transmission line coupled to the device or switch, for example. Furthermore, short-circuit elements may be used singularly or in pairs to improve the thermal and power handling characteristics of the devices in which they are employed.

Implementation of the thermally conductive short-circuit elements should, in many cases, replace the standard practice of enlarging a coaxial microwave device to increase thermal conduction, convection and radiation capability. In many instances, quarter-wavelength elements are preferable because good heat conduction is the most effective means of providing thermal distribution. Additional conductive elements may be added without significant impact on device size, weight or electrical performance to improve the thermal distribution characteristics.

The short-circuit heat conduction elements may be added to almost any microwave device that suffers from thermal buildup concentrated on the circuit conductors. However, the principles of the present invention may be applied most readily to coaxial type RF switches.

Incorporating thermally conductive short-circuit elements reduces the size, weight and manufacturing costs of high power microwave switches and coaxial devices. For example, conventional high power switches are 2 to 4 times heavier than equivalent low power switches (up to 20 watts at C-band). The manufacturing costs of high power switches are approximately 1.5 to 3 times higher than equivalent low power switches. Consequently, the use of the short-circuit elements in these devices lessens the weight and reduces their manufacturing costs.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 1A and 1B show top and side view of a microwave switch made in accordance with the principles of the present invention, and which is illustrative of one coaxial microwave device in which the present invention may be employed;

DETAILED DESCRIPTION

Figure 2:
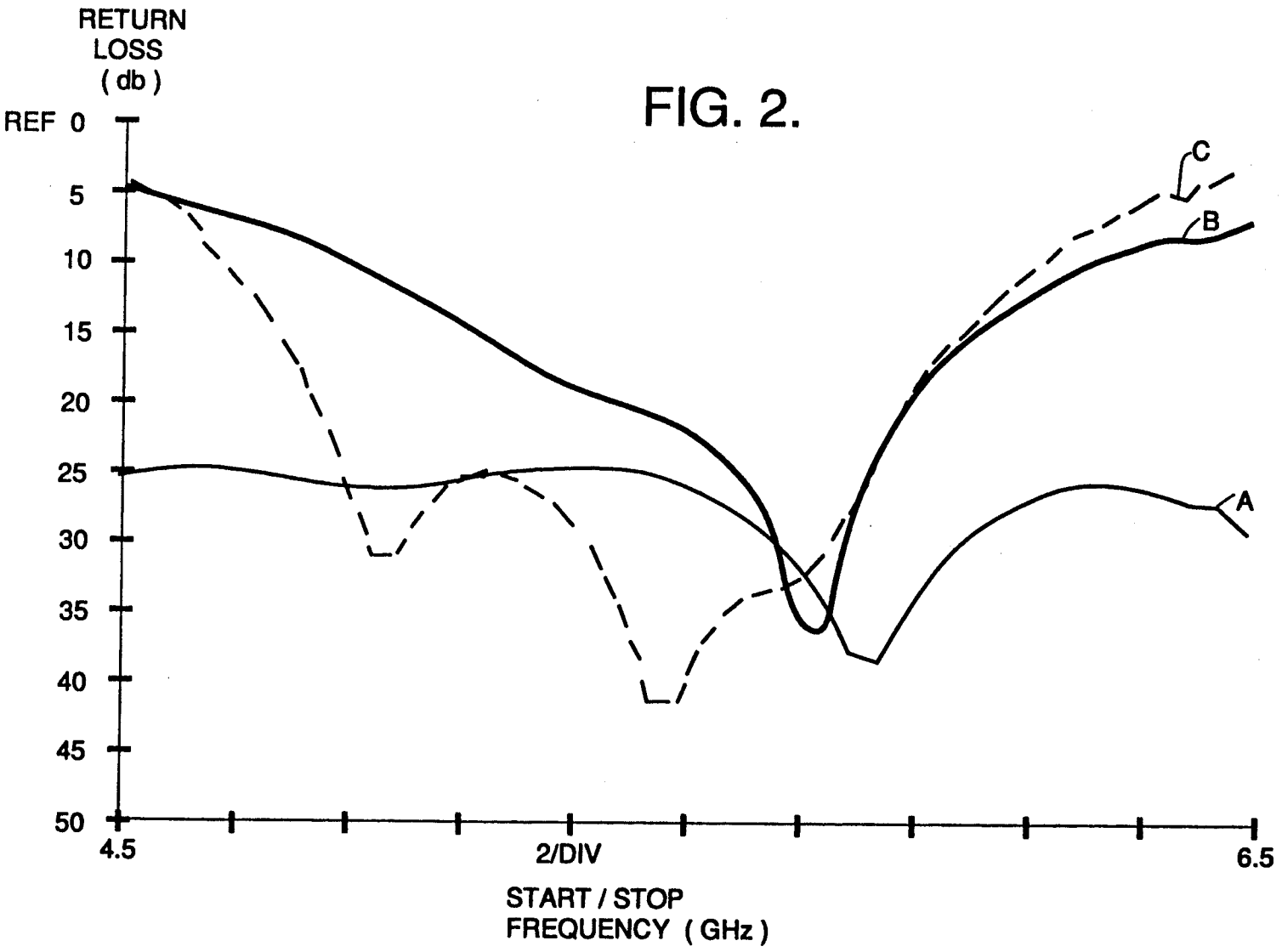
FIG. 2 shows the return loss versus frequency of the microwave switch of FIGS. 1A and 1B.

The present invention is applicable to many coaxial-type RF device types. However, the following detailed description is directed towards its usage in an exemplary embodiment of a coaxial-type RF microwave switch 10.

With reference to the drawing figures, FIGS. 1A and 1B show top and side views of the coaxial microwave switch 10 made in accordance with the principles of the present invention. The switch 10 comprises a body or outer conductor 20 having an open portion 21 typically comprising a gap filled with air or other suitable dielectric material disposed between the outer conductor 20 and a coaxial input conductor 14 and two coaxial output conductors 15, 16. The input conductor 14 and the first and second output conductor 15, 16 are oriented substantially parallel to one another and are typically disposed in a coplanar arrangement.

The switch 10 has first and second movable electrically conductive contact assemblies 23A, 23B that are adapted to provide for electrically conductive bridging between the input conductor 14 and the output conductors 15, 16. The movable contact assemblies 23A, 23B are each comprised of first and second electrically conductive bar arrangements that are adapted to provide a movable electrically conductive bridge between the input and output conductors 14, 15, 16. More specifically, a first conductive member or conductor bar 11 is secured by, or disposed between, two dielectric supports 12A, 13A, and extends laterally between the input conductor 14 and the first output conductor 15. A second conductive member or conductor bar 17 is secured by, or disposed between, two dielectric supports 12B, 13B, and extends laterally between the input conductor 14 and the second output conductor 16. The conductor bars 11, 17 may be made of a conductive material such as copper, for example. The conductors 14, 15, 16 may be made of a conductive material such as copper, for example, and the dielectric supports 12A, 12B, 13A, 13B may be comprised of any conventional dielectric material such as Rexolite, for example.

In accordance with the specific teachings of the present invention, first and second short-circuit thermally conductive elements, which in this specific embodiment comprise first and second quarter-wavelength short-circuit thermal conductors 18, 19 are respectively coupled between ends of the first and second output conductors 15, 16 and the body 20. The first and second quarter-wavelength short-circuit thermal conductors 18, 19 may be comprised of any conventional thermally and electrically conductive material such as copper, for example.

It is to be understood that short-circuit elements having element lengths other that one-quarter-wavelength (such as those of the first and second quarter-wavelength short-circuit thermal conductors 18, 19 of the disclosed specific embodiment illustrating the present invention), may be employed to offset mismatches in a transmission line coupled to a particular device or switch 10, for example. Furthermore, short-circuit elements may be used singularly or in pairs to improve the thermal and power handling characteristics of the devices in which they are employed, and are not limited to the specific disclosed number and arrangement shown in FIGS. 1A and 1B.

Typically, the average RF power handling capability of coaxial switches is limited by the heat generated from internal losses (ohmic, contacts, dielectric) in its RF components. By adding the two quarter-wavelength short-circuit thermal conductors 18, 19, a simple and inexpensive means of channeling heat away from hot spots generated within the switch 10 is provided.

Operationally, in its "off" state, an upward force applied on the first contact assembly 23A pushes the first conductor bar 11 away from the first input conductor 14 and the output conductor 15. In its "on" state, a downward force on the second contact assembly 23B pushes the second conductor bar 17 into intimate contact with the input and output conductors 14, 16. In this state, a circuit connection is completed and RF power flows from the input conductor 14 through second conductor bar 17 to the output conductor 16. As RF power increases, heat rises accordingly and failure might normally result as temperature exceeds the operating limits of individual components of the switch 10. However, due to the use of the quarter-wavelength short-circuit thermal conductors 18, 19 coupled to the respective first and second output conductors 15, 16, the heat on the input and output conductors 14, 15, 16 is transferred to the outer conductor 20 (body) of the switch 10, thus increasing the power handling capacity of the switch 10 and increasing its life expectancy.

Figure 3:
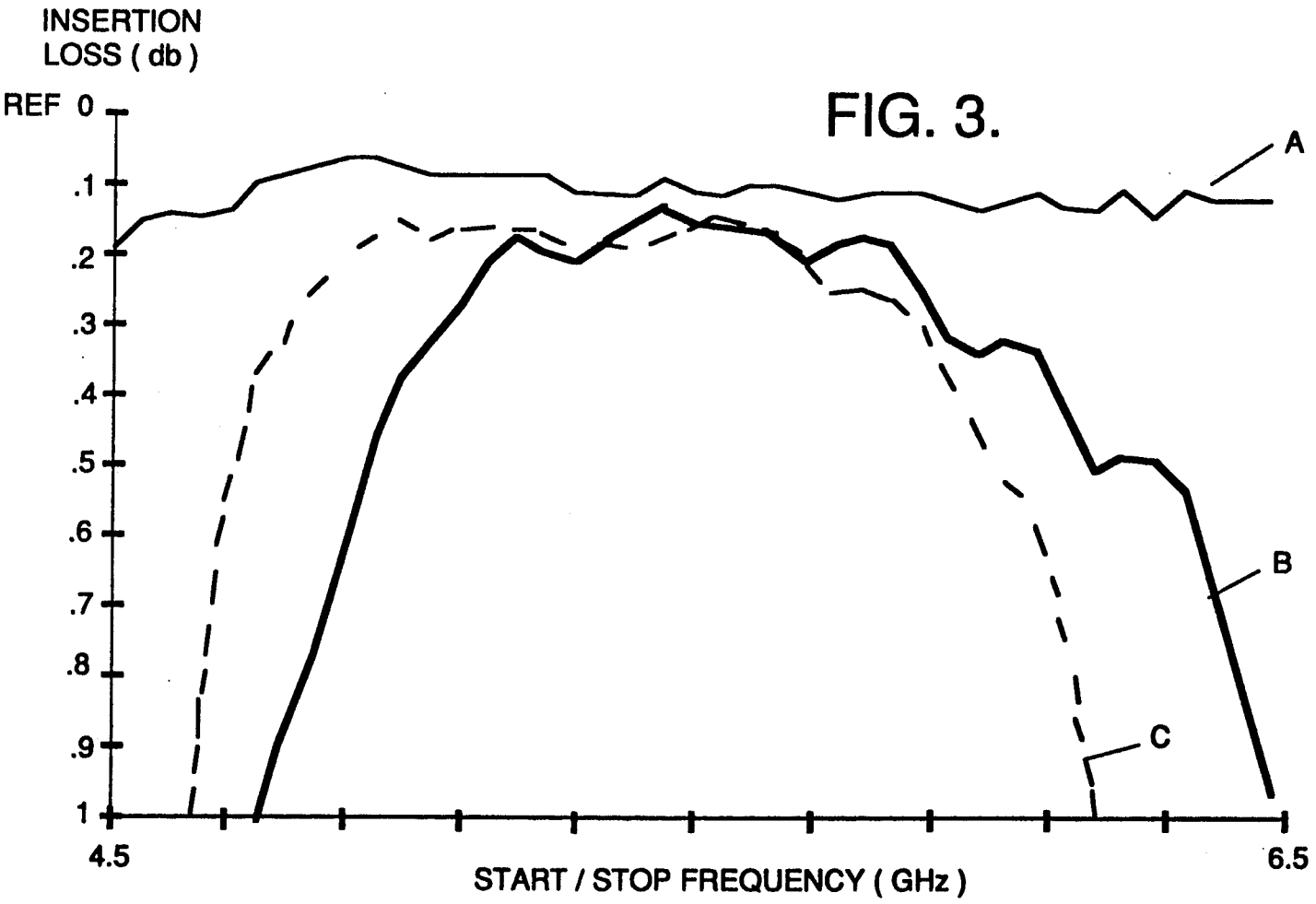
FIG. 3 shows insertion loss versus frequency of the microwave switch of FIGS. 1A and 1B.

FIG. 2 shows the return loss versus frequency of the microwave switch 10 of FIGS. 1A and 1B employing the quarter-wavelength short-circuit thermal conductors 18, 19. FIG. 3 shows insertion loss versus frequency of the microwave switch 10 of FIGS. 1A and 1B. In FIGS. 2 and 3, curve "A" illustrates reference data without the use of the quarter-wavelength short-circuit thermal conductors, curve "B" illustrates data wherein one of the quarter-wavelength short-circuit thermal conductors is employed and curve "C" illustrates data wherein both of the quarter-wavelength short-circuit thermal conductors are employed. The data indicates that, without any impedance matching, the performance of the switch 10 remains relatively good over a ten percent frequency bandwidth.

Thus there has been described a new and improved microwave coaxial device employing short-circuit elements to increase operating power capability. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A high capacity, thermally stable coaxial microwave device comprising:
   an inner element subject to heat accumulation;
   an outer thermally conductive element dielectrically separated and thermally isolated from the inner element; and
   a thermal conductor coupled between the inner and outer elements for conducting heat from the inner element to the outer element, wherein the thermal conductor comprises a quarter wavelength electrical short circuit conductor.

2. A high capacity, thermally stable coaxial microwave device comprising:
   an inner element subject to heat accumulation;
   an outer thermally conductive element dielectrically separated and thermally isolated from the inner element;
   a thermal conductor coupled between the inner and outer elements for conducting heat from the inner element to the outer element; and
   a transmission line having inner and outer elements that are coupled to the inner and outer elements, respectively, of the coaxial microwave device, and wherein the thermal conductor has a length that is adapted to offset tuning mismatches due to the transmission line.

3. A high capacity, thermally stable coaxial microwave device comprising:
   an inner element subject to heat accumulation;
   an outer thermally conductive element dielectrically separated and thermally isolated from the inner element; and
   a thermal conductor coupled between the inner and outer elements for conducting heat from the inner element to the outer element, wherein the thermal conductor comprises a plurality of discrete connectors extending between and thermally coupled to the inner and outer elements.

4. A high capacity, thermally stable coaxial microwave switch comprising:
   an outer thermal conductor;
   an input conductor and first and second coaxial output conductors dielectrically separated and thermally isolated from the outer conductor and subject to heat accumulation;
   a first movable contact assembly comprising a first electrically conductive member extendable laterally between the input conductor and the first output conductor to selectively provide an electrically conductive connection therebetween;

a second movable contact assembly comprising a second electrically conductive member extendable laterally between the input conductor and the second output conductor to selectively provide an electrically conductive connection therebetween; and a first thermal conductor coupled between a selected end of the first output conductor and the outer conductor and a second thermal conductor coupled between a selected end of the second output conductor and the outer conductor, the first and second thermal conductors conducting heat from the input and output conductors and movable contact assembly to the output conductor.

5. The coaxial microwave switch of claim 4 wherein the input conductor and the first and second output conductors are oriented substantially parallel to one another and are disposed in a substantially coplanar arrangement.

6. A high capacity, thermally stable coaxial microwave switch comprising:

an outer thermally conductive conductor having a hollow cavity;

a coaxial input conductor and first and second coaxial output conductors disposed in the hollow cavity and dielectrically separated from the outer conductor, the input and output conductors being subject to heat accumulation in use;

a first movable contact assembly comprising a first electrically conductive member extendable laterally between the input conductor and the first output conductor to selectively provide an electrically conductive connection therebetween, which first electrically conductive member is movable in a direction transverse to the orientation of the input and output conductors;

a second movable contact assembly comprising a second electrically conductive member extendable laterally between the input conductor and the second output conductor so as to provide selective electrically conductive connection therebetween, which second electrically conductive member is movable in a direction transverse to the orientation of the input and output conductors; and first and second quarter-wavelength short-circuit thermal conductors thermally coupled between the first and second output conductors, respectively, and the outer conductor for conducting heat from the input and output conductors and movable contact assemblies to the outer conductor.

7. The coaxial microwave switch of claim 6 wherein the input conductor and the first and second output conductors are oriented substantially parallel to one another and are disposed in a substantially coplanar arrangement.

* * * * *